US005112040A

United States Patent [19]

Johnston et al.

[11] Patent Number: 5,112,040

[45] Date of Patent: May 12, 1992

[54] SHEET SEPARATING APPARATUS

[75] Inventors: Adam J. L. Johnston; James N. T. Doig, both of Dundee, England

[73] Assignee: NCR Corporation, Dayton, Ohio

[21] Appl. No.: 557,817

[22] Filed: Jul. 26, 1990

[30] Foreign Application Priority Data

Mar. 23, 1990 [GB] United Kingdom ..... 9006542

[51] Int. Cl.[5] ..... B65H 5/08

[52] U.S. Cl. ..... 271/11; 271/90; 271/106; 271/107; 271/108

[58] Field of Search ..... 271/99, 100, 107, 108, 271/90, 96, 104, 105, 106, 11

[56] References Cited

U.S. PATENT DOCUMENTS

| | | | |
|---|---|---|---|
| 4,090,702 | 5/1978 | Wirz | 271/108 |
| 4,279,412 | 7/1981 | Glatz | 271/108 |
| 4,391,439 | 7/1983 | Edstrom | 271/108 X |
| 4,436,300 | 3/1984 | Goi | 271/108 X |
| 4,513,957 | 4/1985 | Schaefer, Jr. | 271/108 X |
| 4,516,763 | 5/1985 | Stahl et al. | 271/107 X |
| 4,524,691 | 6/1985 | Miller | 271/107 X |
| 4,709,991 | 12/1987 | Illig et al. | 271/42 |
| 4,767,113 | 8/1988 | Hasegawa et al. | 271/107 X |
| 5,016,865 | 5/1991 | Ioka et al. | 271/107 X |

FOREIGN PATENT DOCUMENTS

| | | | |
|---|---|---|---|
| 73468 | 6/1977 | Japan | 271/107 |
| 2085411 | 4/1982 | United Kingdom . | |

*Primary Examiner*—H. Grant Skaggs
*Assistant Examiner*—Boris Milef
*Attorney, Agent, or Firm*—Elmer Wargo

[57] ABSTRACT

A currency note picking apparatus includes pick mechanisms for picking notes from stacks of notes held in associated currency cassettes. Each pick mechanism includes pivotally mounted pick arms connectable via an electrically operated valve to a diaphragm pump which generates, continuously, a reduced pressure. During a relevant pivotal movement, the pick arms of a selected pick mechanism pick part of an end note out of the associated cassette by applying a suction force to this note. A timing disc rotates in synchronism with the pivotal movement of the pick arms, and an associated optical sensor generates timing signals which are indicative of the position of the pick arms relative to the cassette. The timing signals control the operation of the respective valve so as to enable the pump to communicate with the pick arms during the relevant pivotal movement thereof. The apparatus further includes a temperature indicating device which senses the temperature inside the apparatus and which is utilized by a controller to adjust the pick mechanism vacuum based upon the sensed temperature.

7 Claims, 8 Drawing Sheets

SHEET SEPARATING APPARATUS

BACKGROUND OF THE INVENTION

This invention relates to a sheet separating apparatus for removing sheets one by one from a stack of sheets.

The invention has application, for example, to a currency note picking apparatus for extracting notes from a currency cassette used in an automated teller machine (ATM). As is well known, in operation of an ATM a user inserts a customer identifying card into the machine and then enters certain data (such as codes, quantity of currency required or to be paid in, type of transaction, etc.) upon one or more keyboards associated with the machine. The machine then processes the transaction, updates the user's account to reflect the current transaction, dispenses cash when requested, (extracted from one or more currency cassettes mounted in the machine), and returns the card to the user as part of a routine operation.

One known kind of sheet separating apparatus is represented by a currency note picking mechanism which incorporates pivotably mounted vacuum operated pick arms disposed adjacent an associated currency cassette. The pick arms are arranged to draw part of an end note of a stack of notes in the cassette away from the remainder of the stack by applying suction force to the end note, and to position said part for engagement by transport means arranged to remove the end note from the cassette. The pick arms are pneumatically connected to a piston operated vacuum pump via mechanical timing means. Because the reduced pressure generated by the piston operated pump varies in a periodic manner, precise mechanical timing is required to ensure that a maximum suction force is applied by the pick arms when needed. Some problems have been experienced with this known apparatus in that timing drift may occur due to component manufacturing variations and wear, resulting in possible failure to pick a currency note.

U.K. Patent Application 2085411 A discloses a currency note picking apparatus including pivotably mounted suction heads pneumatically connected via a mechanical timing valve to a vane pump which in operation continuously generates a reduced pressure. The timing valve is mounted to operate in synchronism with the swinging movement of the suction heads and is arranged to control the time at which reduced pressure is applied to the suction heads. Although this apparatus avoids problems due to periodically varying reduced pressure, it has the disadvantages that the mechanical valve requires precise construction, and that the timing of the operation of the mechanical valve is not readily adjustable so that problems are likely to be experienced in maintaining reliable operation in the face of changing operational requirements.

SUMMARY OF THE INVENTION

It is an object of the present invention to provide a sheet separating apparatus for removing sheets one by one from a stack, which apparatus alleviates the aforementioned disadvantages and problems experienced with known sheet separating apparatuses.

According to the invention there is provided an apparatus for removing sheets one by one from a stack of sheets held in a container, comprising:

pump means for continuously generating a reduced pressure in operation;

suction means connected to said pump means and mounted in said apparatus for pivotal movement between first and second positions, said suction means serving when moved from said first position to said second position to withdraw part of an end sheet from said stack of sheets away from said stack of sheets by applying a suction force to said end sheet to move said end sheet to a pick-up area;

transport means to pick up said end sheet at said pick-up area and to remove said end sheet from said container;

valve means for connecting said pump means to said suction means; and timing means for generating timing signals indicative of the position of said suction means relative to said container;

said timing signals serving to control the operation of said valve means to enable said pump means to communicate with said suction means during the movement of said suction means from said first position to said second position.

One embodiment of the invention will now be described by way of example with reference to the accompanying description, claims, and drawing.

DETAILED DESCRIPTION OF THE PREFERRED EMBODIMENT

Figure 1:
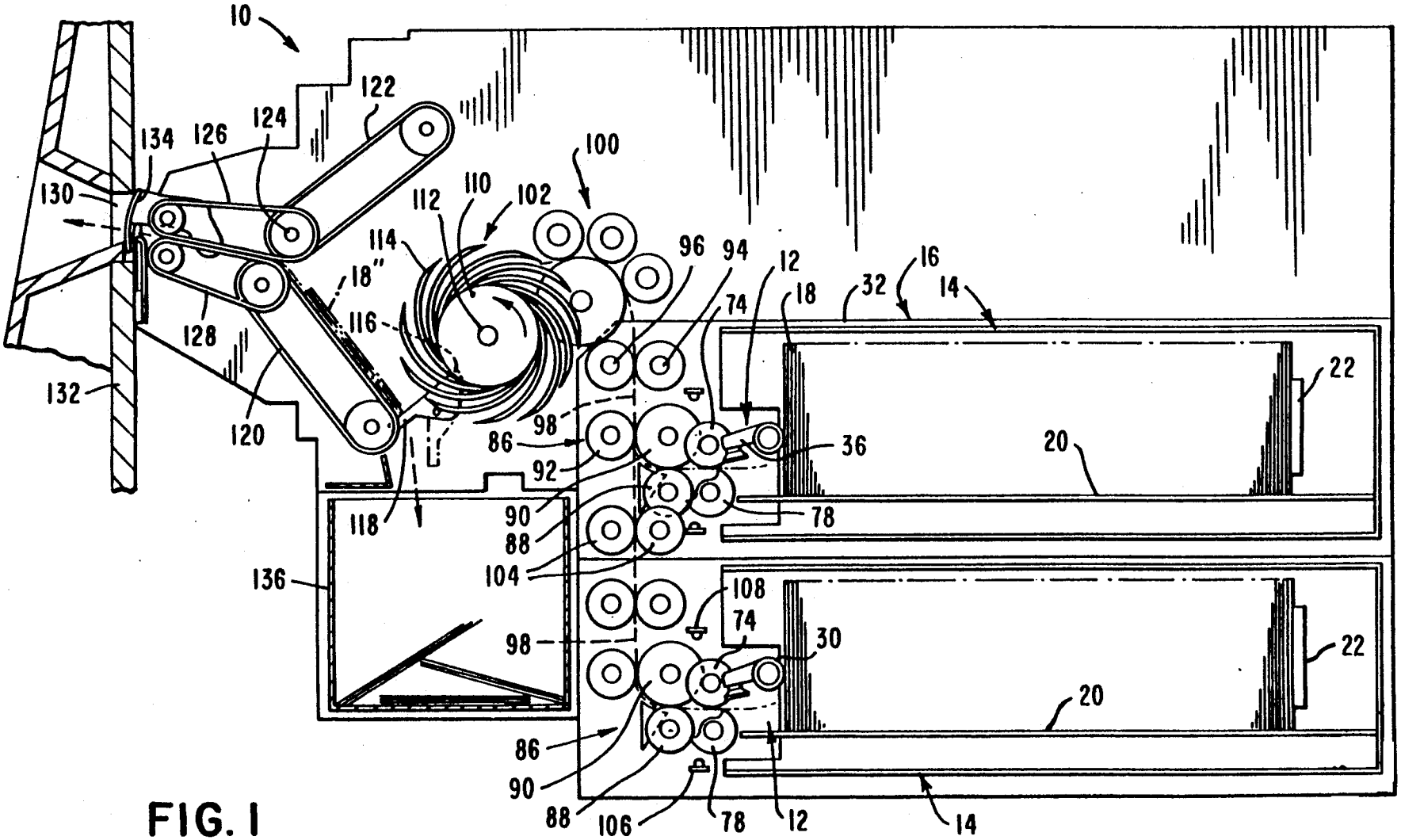
FIG. 1 is a schematic side elevational view of a cash dispenser unit of an ATM incorporating a currency note picking apparatus made in accordance with this invention, with parts of the picking apparatus being omitted.

Referring to FIG. 1, a cash dispenser unit 10 shown therein includes two similar pick mechanisms 12 arranged one above the other and respectively associated with two currency cassettes 14 which are removably mounted in a supporting framework 16 of the dispenser 10. Each of the cassettes 14 is arranged to contain a stack of currency notes 18, corresponding long edges of which are supported on a horizontal support plate 20 mounted in the cassette 14. The two cassettes 14 respectively contain notes 18 of different denominations.

Figure 2:
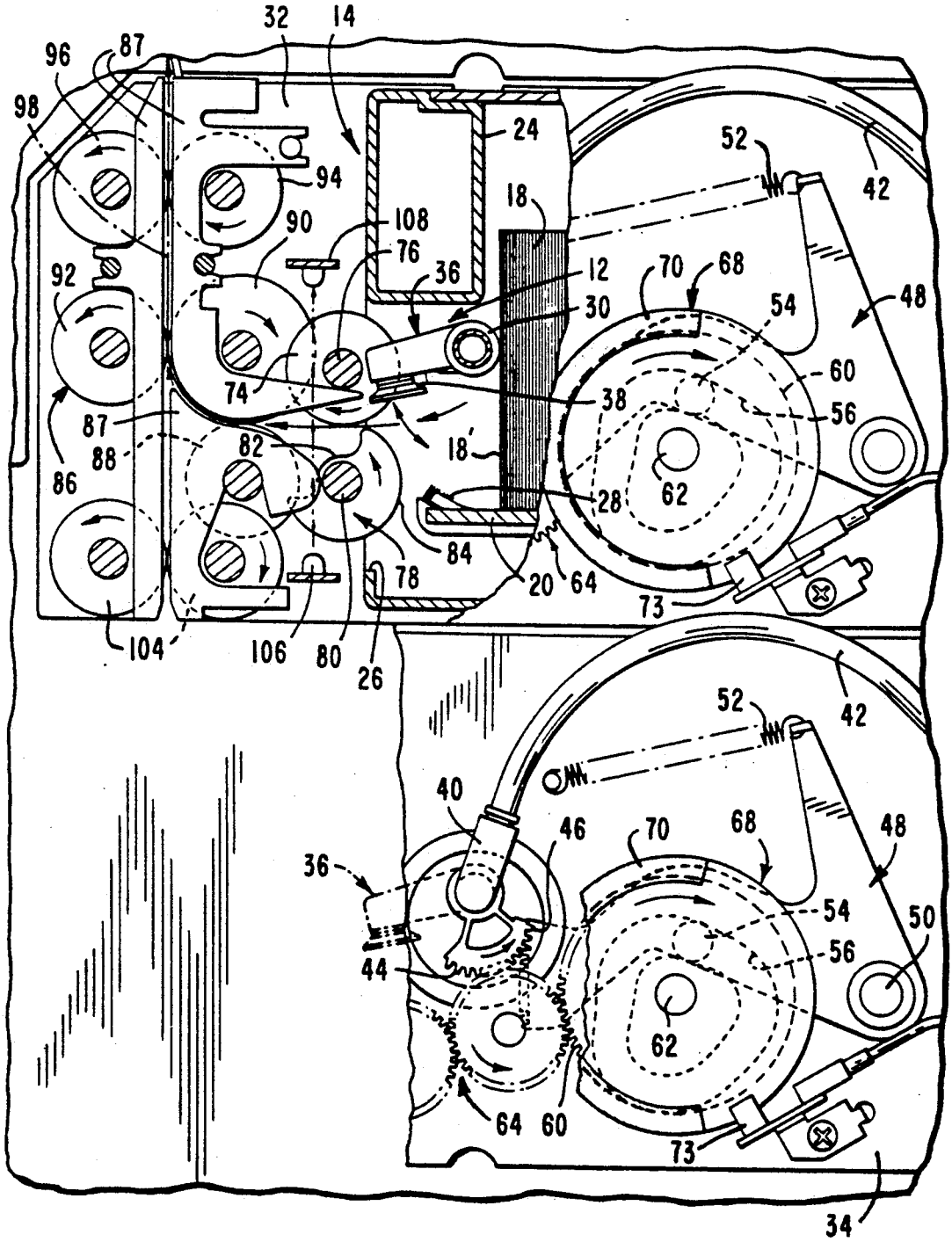
FIG. 2 is an enlarged, part sectional side elevational view of part of the cash dispenser unit of FIG. 1, shown partly broken away and showing additional details of the note picking apparatus.
Figure 3:
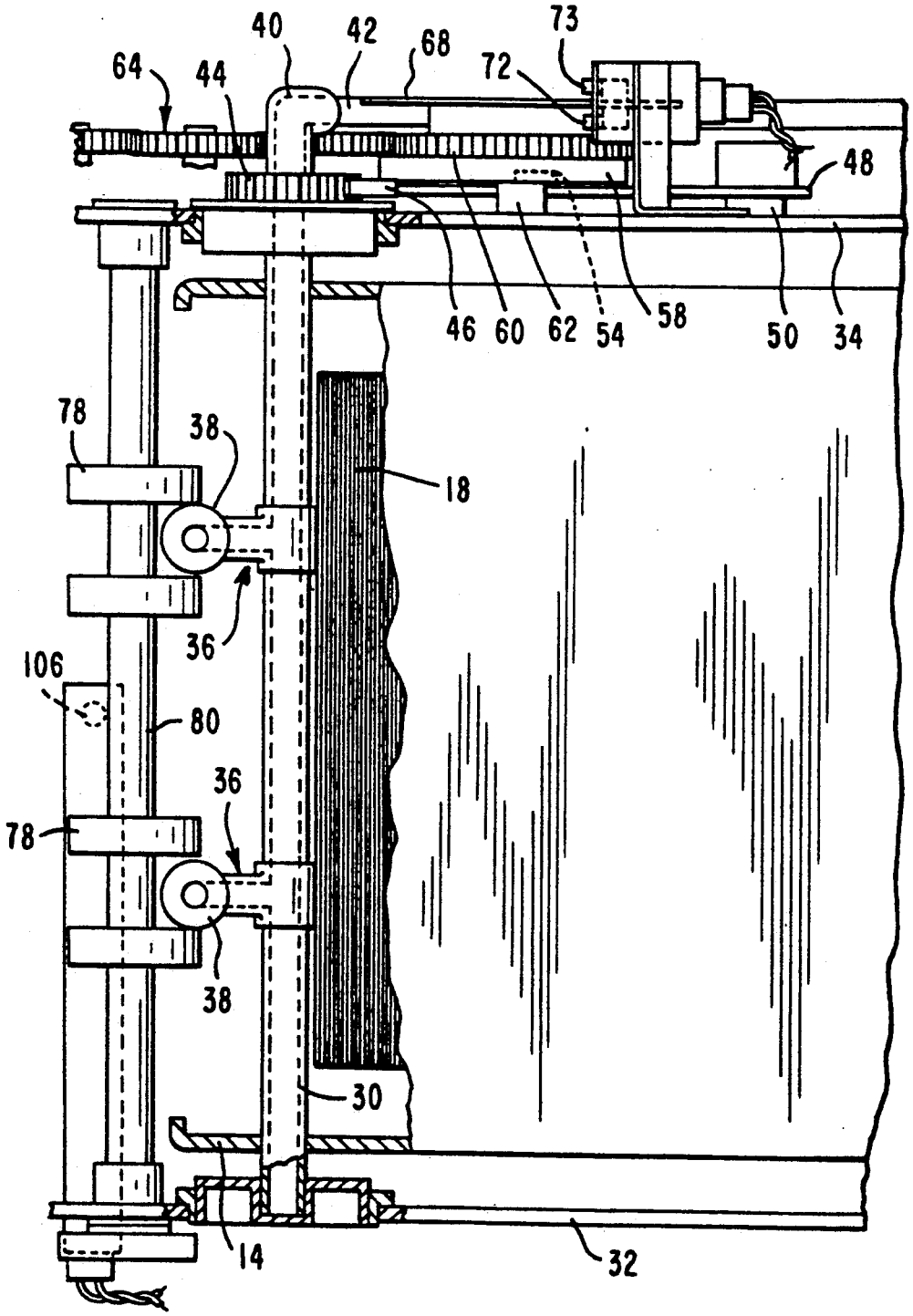
FIG. 3 is an underneath view of part of the apparatus shown in FIG. 2.

Referring now additionally to FIGS. 2 and 3, the stack of notes 18 in each cassette 14 is urged by a spring loaded pusher member 22 (FIG. 1) towards a stop member 24 (FIG. 2) mounted at the front end (left hand end with reference to FIGS. 1 to 3) of the cassette 14. An opening 26 (FIG. 2) is formed in the front end of each cassette 14, the opening 26 being normally closed by conventional shutter means (not shown) when the cassette 14 is not mounted in the dispenser unit 10. When a cassette 14 is mounted in its correct operational position in the dispenser unit 10, the relevant shutter means is automatically retracted away from its closed position so as to enable currency notes 18 to be extracted through the opening 26 by the associated pick mechanism 12. Brushes 28 are provided at the front end of the support plate 20 of each cassette 14 for a purpose which will be explained hereinafter.

Each pick mechanism 12 includes a tubular member 30 (FIG. 3) which extends between, and is rotatably mounted with respect to, side walls 32 and 34 of the framework 16. Two conventional pick arms 36, each incorporating a rubber suction pad 38, are secured on each tubular member 30, each pick arm 36 communicating with the interior of the associated tubular member 30. Corresponding ends of the tubular members 30 project beyond the side walls 34, and are each connected by a respective swivel elbow connector 40 to a respective rubber tube 42 having an internal diameter of 4 millimeters. It should be understood that the connectors 40 provide substantially air-tight connections between the tubular member 30 and the rubber tubes 42, while permitting pivotal movement of the tubular members 30 relative to the connectors 40.

A gear segment 44 (FIG. 3) is secured to that part of each tubular member 30 projecting beyond the side wall 34, the gear segment 44 being in cooperative engagement with a toothed end portion 46 of a first arm of a respective bell crank lever 48 which is pivotably mounted on a stud 50 secured to the outer surface of the wall 34. Each lever 48 is urged to rotate in a counterclockwise direction with reference to FIG. 2 by means of a spring 52, the ends of which are respectively attached to the side wall 34 and to the end of the second arm of the lever 48. A stud 54 is secured to one side of each lever 48, the stud 54 engaging in a cam track 56 formed in an associated cam member 58 (FIG. 3). Each cam member 58 is secured to a respective gear wheel 60 which is rotatably mounted on a respective shaft 62 projecting from the outer surface of the side wall 34. The gear wheels 60 are driven by a gear mechanism 64 operated by a main drive electric motor 66 (FIGS. 4, 5A, 5B and 7). In operation, with the motor 66 energized, the gear wheels 60 are rotated in a clockwise direction with reference to FIG. 2. This rotation of the gear wheels 60 brings about the oscillatory pivotal movement of the levers 48 by virtue of the engagement of the studs 54 in the cam tracks 56, the springs 52 holding the studs 54 in engagement with the inner edges of the cam tracks 56. By virtue of the engagement of the gear segments 44 with the toothed portions 46 of the levers 48, the oscillatory movement of the levers 48 brings about an oscillatory pivotal movement of the assemblies of the tubular members 30 and the associated pick arms 36 so as to cause each pick arm 36 to move between the positions respectively shown in FIG. 2 and FIG. 8B. As will be explained in more detail hereinafter, the oscillatory movement of either of the assemblies of the tubular members 30 and associated pick arms 36 is effective to pick currency notes 18 one by one from the stack of currency notes 18 held in the associated currency cassette 14.

A timing disc 68 (FIG. 2) is secured to that face of each gear wheel 60 remote from the associated cam member 58. Each timing disc 68 is, for the most part, transparent but incorporates an arcuate opaque strip 70 extending around just over half the periphery of the disc 68. Each timing disc 68 is associated with optical sensing means, comprising an LED 72 (FIG. 3) and a cooperating phototransistor sensor 73 which is arranged to sense the opaque strip 70. In operation, as each assembly of a gear wheel 60 and the associated cam member 58 and timing disc 68 rotates in response to energization of the motor 66, the associated sensor 73 generates output signals in response to the sensing of the leading and trailing edges of the associated opaque strip 70. It should be understood that the signals generated by each of the sensors 73 provide indications as to the precise positions of the associated pick arms 36 at the times when these signals are generated. Also, it should be noted that one revolution of the timing disc 68 corresponds to six revolutions of the drive shaft 160 (FIGS. 5A and 5B) of the electric motor 66, one revolution of the timing disc 68 taking about 240 milliseconds.

Each pick mechanism 12 also includes a first set of rolls 74 (FIG. 2) secured on a drive shaft 76, and a second set of rolls 78 (hereinafter referred to as cam rolls) which are secured on a drive shaft 80 in cooperative relationship with respect to the rolls 74, and whose peripheries comprise low portions 82 and high portions 84. The drive shafts 76 and 80 extend between, and are rotatably mounted with respect to, the side walls 32 and 34, and are driven by the gear mechanism 64 so that in operation, the rolls 74 and the cam rolls 78 respectively rotate in clockwise and counterclockwise directions with reference to FIG. 2, the rolls 74 and the cam rolls 78 making two revolutions for each revolution of the timing discs 68. In the course of a pick operation, the lower long edge of the first currency note 18′ of the stack of notes 18 in the relevant cassette 14 is pulled partly out of the cassette 14 by the respective pick arms 36 and is fed between the low portions 82 of the respective cam rolls 78 and the associated rolls 74. The note 18′ is thereafter pulled completely out of the cassette 14 by virtue of being gripped between the high portions 84 of the cam rolls 78 and the rolls 74.

The cash dispenser unit 10 includes two note transport mechanisms 86 (FIG. 2) respectively associated with the two pick mechanisms 12. Each transport mechanism 86 includes guide means 87 and sets of feed rolls 88, 90, 92, 94 and 96 for feeding a currency note picked by the associated pick mechanism 12 along a respective feed path 98 towards a further transport mechanism 100 (FIG. 1) positioned above the mechanisms 86. The transport mechanism 100 serves to feed currency notes one by one to a conventional stacking wheel 102. The sets of cam rolls 78 and cooperating rolls 74 of each pick mechanism 12 feed a picked currency note to cooperating sets of rolls 88 and 90, from where the note is fed by cooperating sets of rolls 90 and 92 and cooperating sets of rolls 94 and 96 upwardly out of the respective transport mechanism 86. The upper one of the transport mechanisms 86 additionally includes two further sets of cooperating rolls 104 for accepting a currency note fed upwardly out of the lower transport mechanism 86 and for feeding this note to the cooperating rolls 90 and 92 of the upper mechanism 86, from where the note is fed to the transport mechanism 100. Further optical sensing means comprising an LED 106 and a cooperating phototransistor sensor 108 are mounted adjacent each pick mechanism 12 for the purpose of sensing the leading edge of a picked currency note fed by the cooperating rolls 74 and 78 of the pick mechanism 12 to the cooperating rolls 88 and 90 of the respective transport mechanism 86.

Referring now particularly to FIG. 1, the stacking wheel 102 is arranged to rotate continuously in operation in a counterclockwise direction. Means (not shown) are provided between the upper transport mechanism 86 and the stacking wheel 102 for detecting any multiple feeding of notes and for detecting any invalid or torn note. The stacking wheel 102 comprises a plurality of stacking plates 110 spaced apart in parallel relationship along the stacker wheel shaft 112, each stacking plate 110 incorporating a series of curved tines 114. The tines 114 of the stacking plates 110 pass between portions 116 of a rockably mounted stripper plate assembly 118. In operation, each note fed by the transport mechanism 100 to the stacking wheel 102 enters between adjacent tines 114 and is carried partly around the axis of the stacking wheel 102, the note being stripped from the wheel 102 by the portions 116 and being stacked against belt means 120 with a long edge of the note resting on the stripper plate assembly 118. The belt means 120 cooperates with belt means 122 normally held in the position shown in FIG. 1. When a bundle of notes 18'' (or possibly a single note only) to be dispensed to a user in response to a cash withdrawal request has been stacked against the belt means 120, the belt means 122 is pivoted (about the shaft 124) in a clockwise direction so as to trap the bundle of notes 18'' between the belt means 120 and the belt means 122. It should be understood that in the course of this pivoting movement separate belts making up the belt means 122 pass between adjacent pairs of the stacking plates 110.

Assuming that none of the notes in the bundle 18'' has been rejected for any reason, the belt means 120 and 122 are operated so as to drive the bundle 18'' to a pair of drive belt means 126 and 128. The belt means 126 and 128 serve to drive the bundle 18'' through a note exit slot 130 in a housing 132 of the ATM to a position where the bundle 18'' can be collected by the user of the ATM, a shutter 134 which serves to close the slot 130 when the ATM is not in operation having previously been retracted to an open position. It should be understood that the belt means 120 and 122 are mounted in resilient relationship relative to each other and the belt means 126 and 128 are also mounted in resilient relationship relative to each other, so that bundles of notes of varying thickness can be held between, and fed by, the belt means 120 and 122 and the belt means 126 and 128. If a multiple feeding has been detected in the course of stacking the bundle of notes 18'' against the belt means 120, or if one or more of the notes in the bundle 18'' have been rejected for any other reason, then the stripper plate assembly 118 is pivoted into the position shown in dashed outline in FIG. 1, and the belt means 120 and 122 are operated to feed the bundle 18'' in a direction opposite to the normal feed direction, the bundle 18'' being deposited in a reject note container 136 via an opening in the top thereof.

Figure 4:
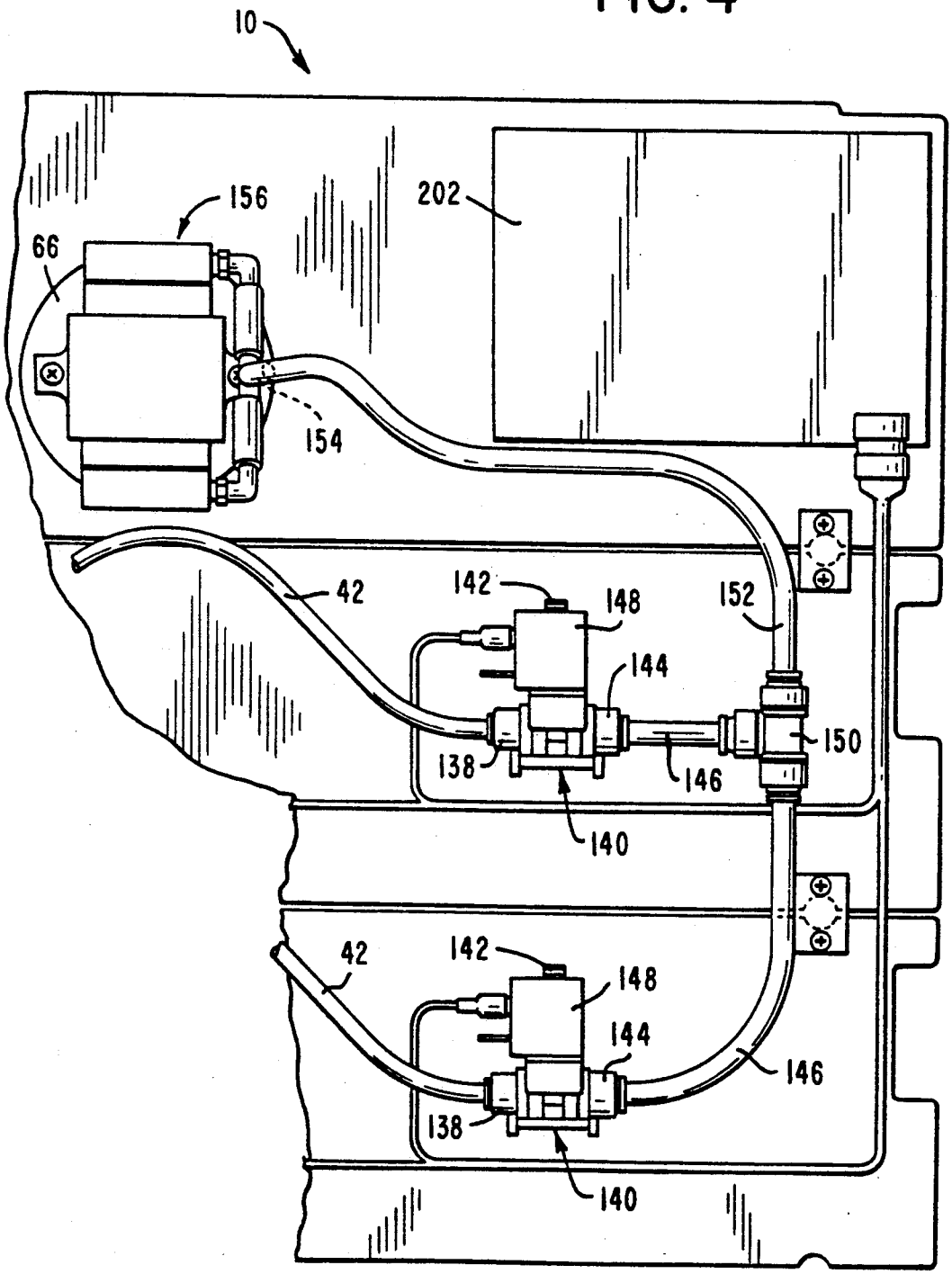
FIG. 4 is a side view of part of the note picking apparatus showing means for applying reduced pressure to pick mechanisms of the apparatus.

Referring now additionally to FIG. 4, that end of each of the rubber tubes 42 remote from the associated swivel elbow connector 40 (FIG. 2) is connected to an inlet port 138 of a respective solenoid operated valve 140. A suitable valve for use as the valve 140 is a series 34 valve supplied by Webber Electro Components Limited of Bristol, England. Each valve 140 also has a vent port 142, and an outlet port 144 connected to a respective rubber tube 146 having an internal diameter of 6 millimeters. When the solenoid 148 of each valve 140 is in a de-energized condition, the outlet port 144 is closed and the vent port 142 is open, the inlet port 138 being connected to the atmosphere via the vent port 142. When the solenoid 148 is in an energized condition, the outlet pot 144 is open and the vent port 142 is closed, the inlet port 138 communicating with the associated rubber tube 146 via the outlet port 144. Those ends of the rubber tubes 146 remote from the valves 140 are connected via a connector 150 and a further rubber tube 152 to an inlet port 154 of a diaphragm pump 156 which is operated by the electric motor 66. It should be understood that, in operation, reduced pressure can be applied by the pump 156 to the tubular member 30 of a selected one of the pick mechanisms 12 by energization of the solenoid 148 of the associated valve 140.

Figure 5A:
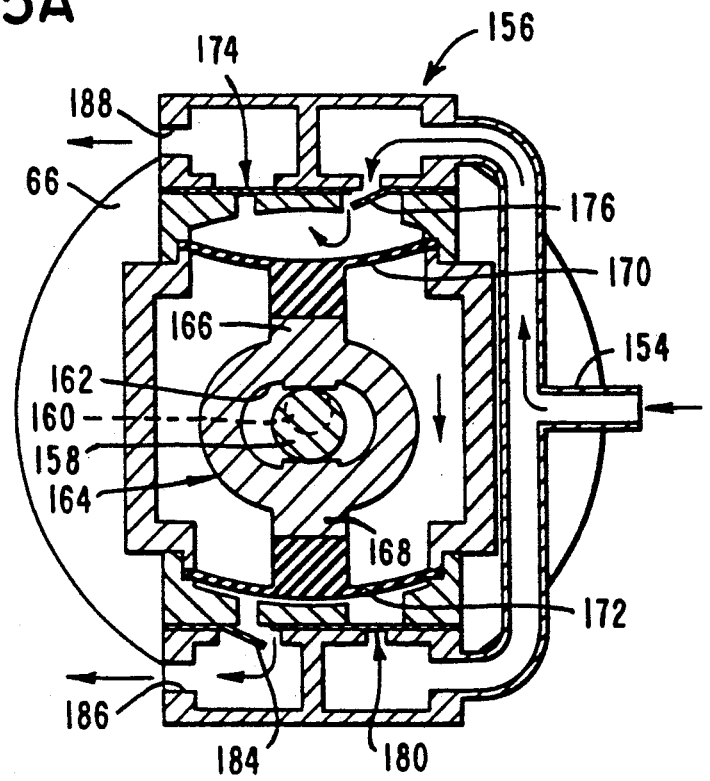
FIG. 5A and 5B are sectional views of a diaphragm pump incorporated in the note picking apparatus, these views showing different operational positions of operating parts of the pump.
Figure 5B:
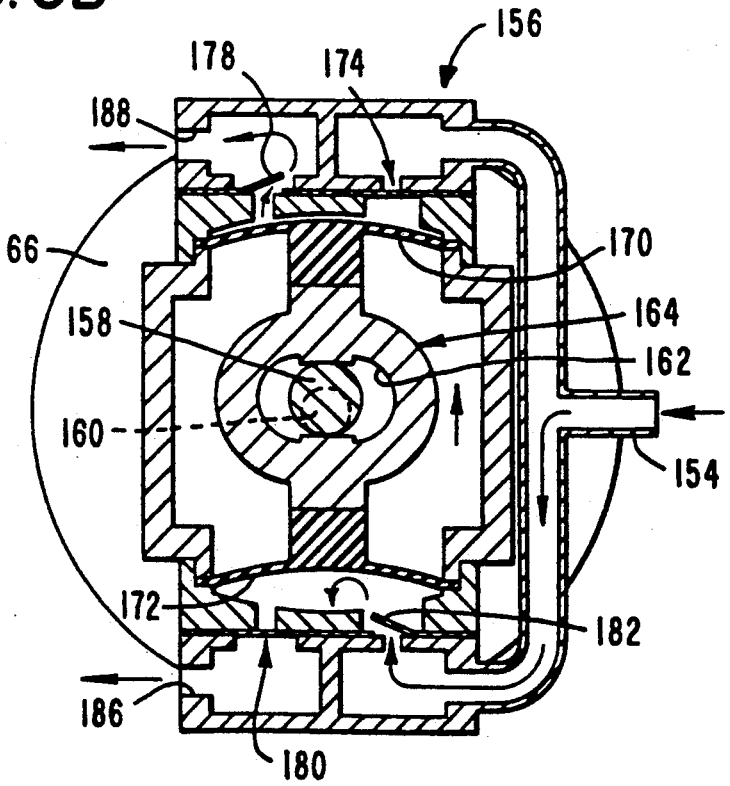

As shown in FIGS. 5A and 5B, the pump 156 is operated by an eccentrically mounted shaft 158 driven by the drive shaft 160 of the motor 66. The eccentrically mounted shaft 158 passes through and makes a rotatable fit with respect to, a central opening 162 in a yoke 164, upper and lower portion 166 and 168 of the yoke 164 being respectively connected to upper and lower rubber diaphragms 170 and 172. An upper rubber gasket 174 having integral flap valves 176 (FIG. 5A) and 178 (FIG. 5B) is mounted above the upper diaphragm 170, and a lower rubber gasket 180 having integral flap valves 182 (FIG. 5B) and 184 (FIG. 5A) is mounted below the lower diaphragm 172. When the shaft 158 rotates through 180° from the position shown in FIG. 5B to the position shown in FIG. 5A, the flap valves 176 and 184 are opened and the flap valves 178 and 182 are closed, the diaphragm 170 drawing air into the pump 156 from the inlet port 154 via the flap valve 176, and the diaphragm 172 expelling air from a first outlet vent 186 of the pump 156 via the flap valve 184. When the shaft 158 rotates through a further 180° from the position shown in FIG. 5A to the position shown in FIG. 5B, the flap valves 178 and 182 are opened and the flap valves 176 and 184 are closed, the diaphragm 172 drawing air into the pump 156 from the inlet port 154 via the flap valve 182, and the diaphragm 170 expelling air from a second outlet vent 188 of the pump 156 from the inlet port 154 via the flap valve 178. Thus, in operation, a reduced pressure is continuously generated at the inlet port 154 in response to rotation of the shaft 158.

Figure 6:
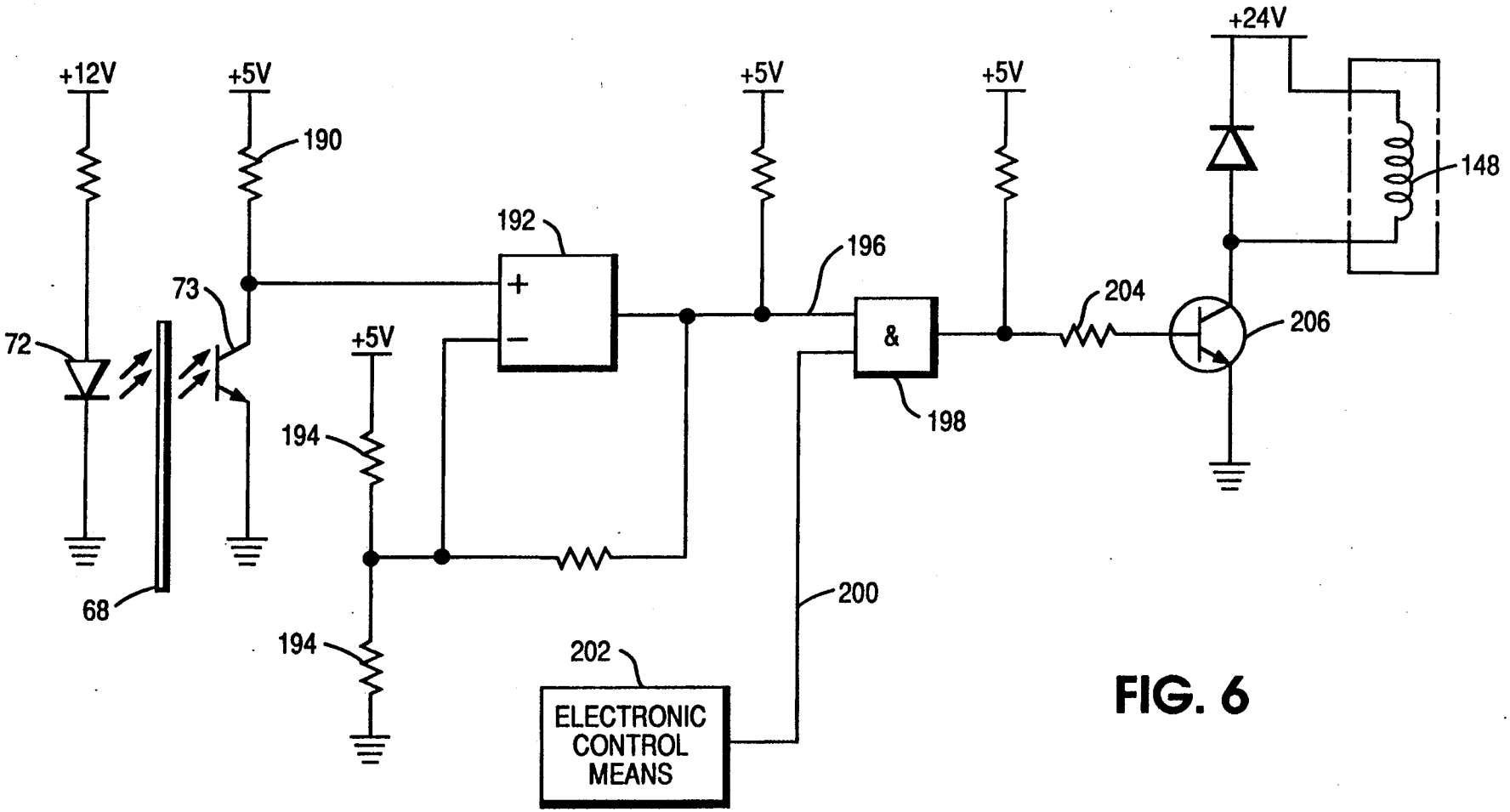
FIG. 6 is a circuit diagram of means for operating solenoid operated valves incorporated in the note picking apparatus.

Each pick mechanism 12 is associated with a respective electrical circuit (FIG. 6) in which are included the LED 72 and the phototransistor 73 associated with the pick mechanism 12. The collector electrode of the phototransistor 73 is connected via a resistor 190 to a +5 V voltage supply and is also connected to a first input terminal of a comparator 192, a second input terminal of which is connected to an intermediate point of a potential divider formed by two resistors 194 connected between the +5 V voltage supply and ground. In operation, when the opaque strip 70 of the associated timing disc 68 is interposed between the LED 72 and the phototransistor 73, the voltage at the collector of the phototransistor 73 goes high, thereby causing a high signal to appear on a line 196 connected to the output of the comparator 192. The line 196 is connected to a first input of an AND gate 198, a second input of which is connected to a line 200 connected to electronic control

BEST AVAILABLE COPY means 202 (see also FIGS. 4 and 7) of the cash dispenser unit 10. The output of the AND gate 198 is connected via a resistor 204 to the gate of a transistor 206. The collector of the transistor 206 is connected to one terminal of the solenoid 148 of the associated valve 140, the other terminal of the solenoid 148 being connected to a +24 V voltage supply. When the electronic control means 202 applies a high signal PICK to the AND gate 198 over the line 200, the output of the AND gate 198 goes high in response to the output of the comparator 192 going high when the leading edge of the relevant opaque strip 70 is sensed by the phototransistor sensor 73. Upon the output of the AND gate 198 going high, the transistor 206 is turned on so as to energize the solenoid 148. As previously explained, energization of the solenoid 148 will cause reduced pressure to be applied to the tubular member 30 of the associated pick mechanism 12 so that the suction pads 38 will apply a suction force to the first note 18' of the associated stack of notes 18. It should be understood that the electronic control means 202 applies a high signal PICK to the line 200 associated with the selected pick mechanism 12 when the relevant sensor 73 is sensing a transparent portion of the associated timing disc 68. Thus, energization of the solenoid 148 of the selected pick mechanism 12 is always initiated by the sensing of the leading edge of the opaque strip 70 of the associated timing disc 68.

The operation of the cash dispenser unit 10 will now be described with additional reference to FIG. 7 and FIGS. 8A to 8D. This operation is controlled by the electronic control means 202. When the main ATM processor (not shown) sends a request to the electronic control means 202 that one or more currency notes are to be dispensed by the dispenser unit 10 in response to a cash withdrawal request by a user of the ATM, the control means 202 sends a signal to the motor 66 so as to switch on the motor 66 and cause the assemblies of the gear wheels 60, cams 58 and timing discs 68 to commence to rotate. After a delay of 250 milliseconds (which corresponds to slightly more than one revolution of each timing disc 68, or six revolutions of the drive shaft 160 of the motor 66), the control means 202 applies a high signal PICK over the relevant line 200 to the AND gate 198 associated with the selected one of the pick mechanisms 12. Upon the phototransistor 73 sensing the leading edge of the opaque strip 70 of the timing disc 68 of the selected pick mechanism 12 with a high signal present on the line 200, the output of the AND gate 198 goes high so as to energize the solenoid 148 of the relevant valve 140.

Figure 8C:
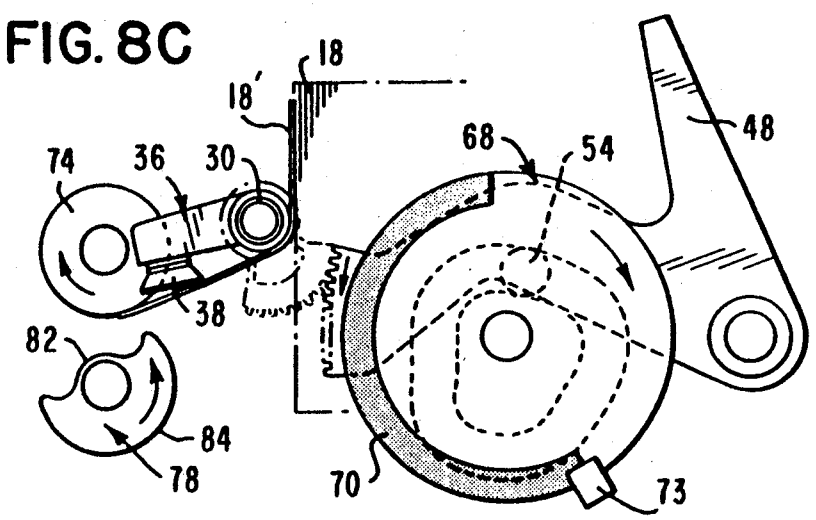
FIGS. 8A to 8D are schematic views illustrating different stages in a cycle of operation of each of the pick mechanisms.
Figure 8D:
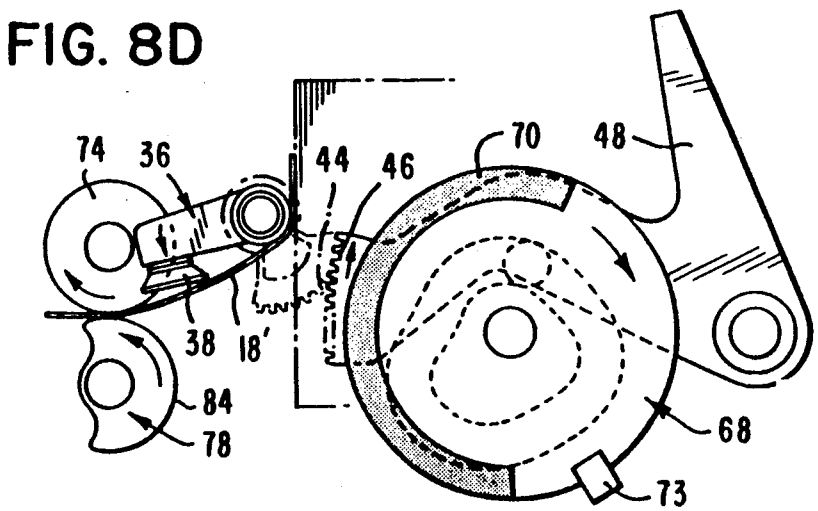
Figure 8A:
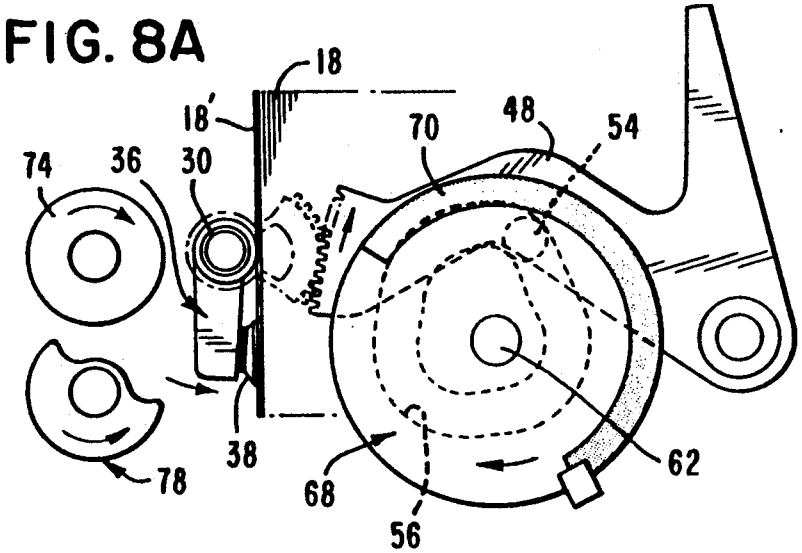
Figure 8B:
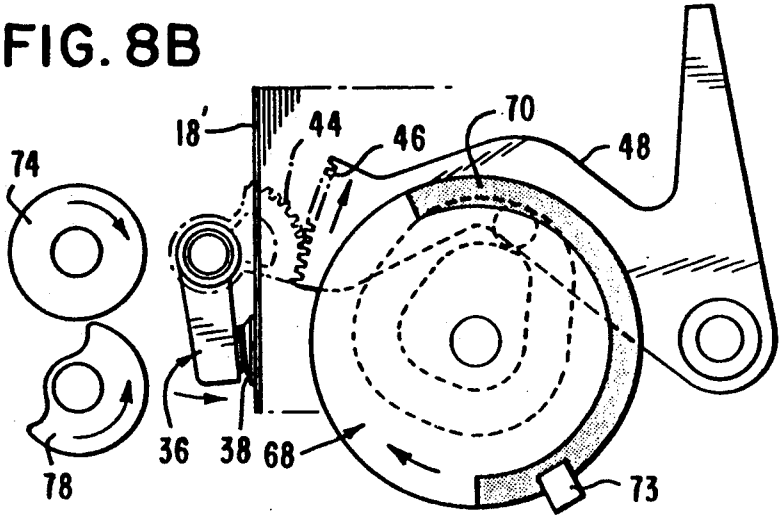

At this time, the timing disc 68 and the pick arms 36 of the selected pick mechanism 12 are in the positions shown in FIG. 8A, the suction pads 38 having just come into contact with the first note 18' of the stack of notes 18 held in the associated cassette 14 in the course of a pivotal movement of the pick arms 36 in a counterclockwise direction. The suction pads 38 form a seal with the first note 18', and since the relevant solenoid 148 has been energized so as to cause the pump 156 to apply a reduced pressure to the relevant tubular member 30, suction is applied by the suction pads 38 to the first note 18'. Thereafter, the pick arms 36 continue to pivot a short amount in a counterclockwise direction. The positions of the pick arms 36 and the timing disc 68 at the end of this pivotal movement are as shown in FIG. 8B, the pick arms 36 having pushed the first note 18' a short distance into the interior of the associated cassette 14. By this time, the seal between the suction pads 38 and the first note 18' has been consolidated by virtue of the suction force applied to the first note 18' by the suction pads 38 continuing to build up as the phototransistor 73 continues to sense the opaque strip 70 of the timing disc 68. Typically, at this time, the reduced pressure applied to the suction pads 38 is about half an atmosphere.

Next, in response to continued rotational movement of the relevant gear wheel 60, the pick arms 36 undergo a pivotal movement in a clockwise direction until they reach the position shown in FIG. 8C. During this pivotal movement, the phototransistor 73 continues to sense the opaque strip 70 so that reduced pressure continues to be applied to the suction pads 38 via the tubular member 30. Because of this applied reduced pressure, the pick arms 36 apply a suction force to the first note 18' so as to pull the lower part of the note 18' out of the associated cassette 14 until the lower end of the note 18' comes into contact with the set of rolls 74 as shown in FIG. 8C. It should be understood that, as the lower end of the note 18' is approaching the rolls 74, the low portions 82 of the cam rolls 78 are facing the rolls 74 so that the cam rolls 78 do not interfere with the movement of the note 18'. At the stage of operation of the relevant pick mechanism 12 illustrated in FIG. 8C, the trailing end of the opaque strip 70 has reached the phototransistor 73 thereby causing the relevant solenoid 148 to become de-energized so that reduced pressure ceases to be applied to the suction pads 38. Accordingly, at this time the suction pads 38 become disengaged from the note 18', while at the same time the high portions 84 of the cam rolls 78 are about to come into cooperative relationship with the rolls 74. Shortly after the note 18' becomes disengaged from the suction pads 38, the note 18' is gripped between the rolls 74 and the high portions 84 of the cam rolls 78 as shown in FIG. 8D. The rolls 74 and 78 pull the note 18' away from the respective cassette 14 until the leading edge of the note 18' enters a pick-up area or the nip of the rolls 88 and 90 of the associated transport mechanism 86, after which the note 18' is pulled completely out of the cassette 14 and fed to the stacking wheel 102 in the manner previously described.

After the note 18' has been fed to the nip of the rolls 88 and 90, the signal on the relevant line 200 (FIG. 6) goes low so that no further reduced pressure is applied to the suction pads 38 until such time as a further signal PICK is applied by the electronic control means 202 to the relevant AND gate 198 over the line 200. It should be understood that, for the entire time that the note 18' is gripped between the rolls 74 and 78, the phototransistor 73 senses the transparent part of the timing disc 68 so that reduced pressure is not applied to the suction pads 38. After the note 18' has been fed to the stacking wheel 102, the electronic control means 202 may cause a series of further pick operations to be carried out in each of which a currency note is picked from one or other of the cassettes 14 in response to the application of a signal PICK to the appropriate AND gate 198. The electronic control means 202 monitors the outputs of the two picked note sensors 108 every 3 milliseconds during a pick operation, and by monitoring these outputs the control means 202 ascertains when the correct number and denomination of notes, in accordance with the cash withdrawal request made by the user of the ATM, has been picked from the cassette 14. Upon the control means 202 ascertaining that the correct number and denomination of currency notes have been picked from the cassettes 14, the control means 202 returns the cash dispenser unit 10 to its quiescent condition by de-energizing the motor 66 and holding the voltages on the lines 200 at a low level. When these last-mentioned voltages are at a low level, both the solenoids 148 are held in a de-energized condition, with the inlet ports 138 of the valves 140 being disconnected from the outlet ports 144 and being connected to the atmosphere via the vent ports 142. With the cash dispenser unit 10 in its quiescent condition, the pick arms 36 of each of the pick mechanisms 12 are in the position shown in FIG. 2 in which they are fully retracted with respect to the stack of notes 18 held in the associated cassette 14.

When the first note 18' is being picked from the associated cassette 14, it is possible, due to a certain amount of porosity of the first note 18', for the second note of the stack of notes 18 to commence to be drawn away from the remainder of the stack together with the first note 18'. The brushes 28 (FIG. 2) will normally prevent the second note being drawn out of the cassette 14 together with the first note 18', since, in the event of the first and second notes commencing to be drawn out of the cassette 14, the brushes 28 flex the lower ends of these notes, thereby interrupting the application of suction force to the second note and so permitting the second note to fall back into its correct position in the cassette 14.

Figure 7:
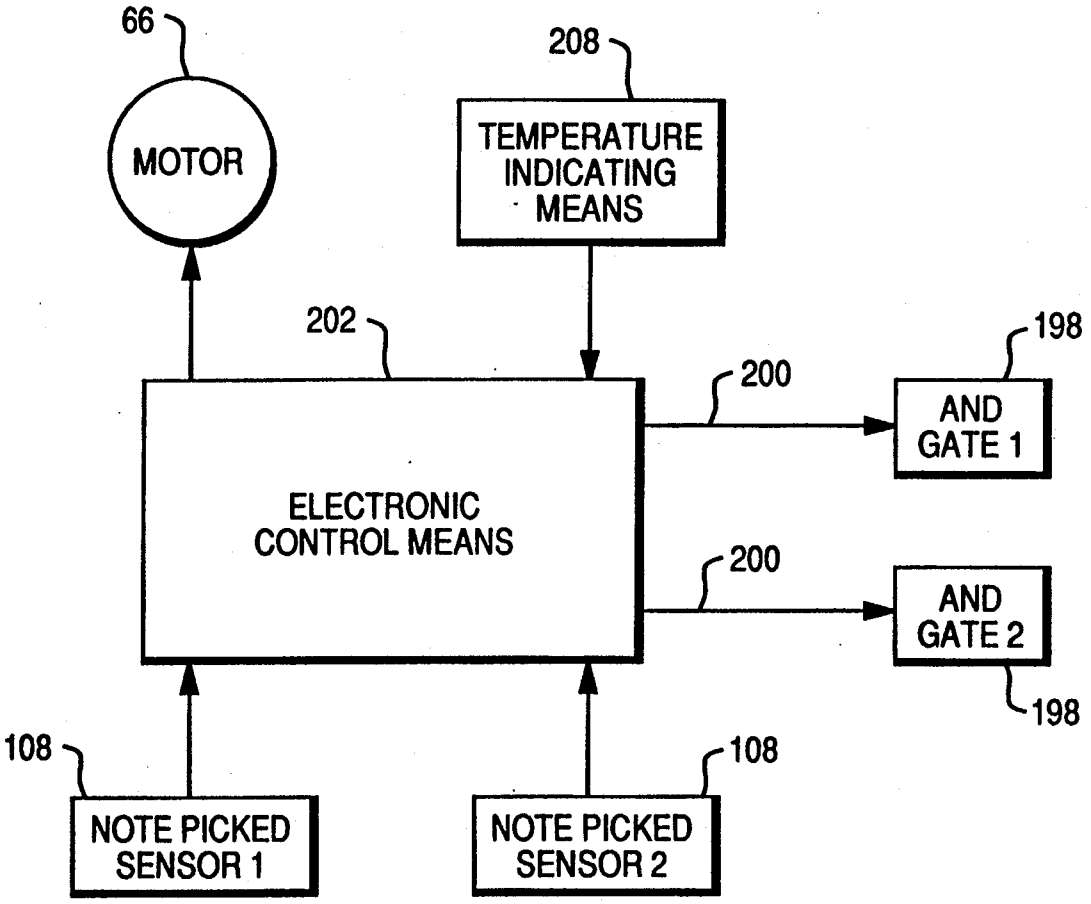
FIG. 7 is a schematic block diagram illustrating electrical interconnections between parts of the note picking apparatus.

With reference to FIG. 7, the cash dispenser unit 10 includes in the vicinity of the pick mechanisms 12 a temperature indicating means 208 having an output connected to the electronic control means 202. In operation, there appears on the output of the temperature indicating means 208 a signal indicative of the temperature in the interior of the unit 10.

If the temperature indicated by the indicating means 208 is below a predetermined minimum temperature specification stored in the control means 202, then, following the initiation of a pick operation, the control means 202 applies a signal PICK to the relevant AND gate 198 after a delay of 500 milliseconds following the energization of the motor 66, compared with a normal delay of 250 milliseconds if the indicated temperature is at or above the minimum temperature specification. This increased delay enables a stronger vacuum (i.e. pressure reduced more than normal) to be built up in the tubes 146 connected to the outlet ports 144 of the valves 140 by the time the signal PICK is applied to the relevant AND gate 198, so that a stronger suction force is applied by the relevant suction pads 38 to the first note 18' in the associated cassette 14 when the relevant solenoid 148 is energized. This increased suction force compensates for the fact that as the suction pads 38 are at a lower temperature than normal they are less flexible than normal and so require a stronger suction force in order to make an effective seal with the first note 18'.

If, following the initiation of a pick operation, the output of the relevant note picked sensor 108 indicates that no note has been picked and fed to the stacking wheel 102 within a predetermined time, then the electronic control means 202 determines that there has been no sheet removed or there has been a pick failure. When the control means 202 determines that there has been a pick failure, the control means 202 terminates the current pick operation, by de-energizing the motor 66 and terminating the signal PICK on the relevant line 200, and then initiates a first retry pick operation. In the first retry pick operation, the control means 202 applies a signal PICK to the relevant AND gate 198 after a delay of 1.2 seconds following the energization of the motor 66. Accordingly, in the first retry pick operation, a stronger vacuum will be applied to the relevant suction pads 38 compared with the vacuum which was applied in the pick operation which resulted in pick failure. As a result, a stronger suction force will be applied by the relevant suction pads 38 to the first note 18' so that there is a good possibility that the first retry pick operation will be successful, resulting in the first note 18' being picked from the relevant suction pads 38 to the first note 18' so that there is a good possibility that the first retry pick operation will be successful, resulting in the first note 18' being picked from the relevant cassette 14 and fed to the stacking wheel 102.

If the first retry pick operation is not successful, then the control means 202 will initiate a second retry pick operation. In the second retry pick operation, the control means 202 applies a signal PICK to the relevant AND gate 198 after a delay of 10 seconds following the energization of the motor 66 so that an even stronger vacuum will be applied to the relevant suction pads 38. Thus even though the first retry pick operation was unsuccessful, there is a reasonable chance that the second retry pick operation will be successful. If the second retry pick operation is unsuccessful, the control means 202 will initiate a third retry pick operation, again using a delay of ten seconds, and if the third retry pick operation is unsuccessful the control means 202 will render the relevant pick mechanism 12 non-operational and will generate a signal to the effect that this pick mechanism 12 requires attention by bank or service personnel.

Possible causes of a pick failure are that the first note 18' has become excessively porous through long usage, or that, in the region of the first note 18' where the suction pads 38 make contact, the note 18' is folded or torn or has holes therein, so that an effective vacuum seal is not established at the surface of the note 18'. If a pick failure occurs due to such defect in the first note 18', then, when a stronger vacuum is applied by the suction pads 38 to the first note 18' in the course of a retry pick operation, it is possible for a strong suction force to be applied through the first note 18' to the next note in the stack, resulting in both notes being drawn out of the relevant cassette 14, this suction force being effective to overcome the action of the brushes 28. The two notes thus drawn out of the cassette 14 and fed to the stacking wheel 102 will be detected by the multiple feeding detect means (not shown) previously referred to and will be deposited in the reject note container 136. The defective note having been cleared from the relevant cassette 14, normal picking of notes from this cassette 14 can now be resumed.

If one of the note picked sensors 108 provides an indication to the control means 202 that a note has been left interposed between the LED 106 and the sensor 108, possibly as a result of a jam occurring in the relevant pick mechanism 12, then this is another situation where the control means 202 will render the pick mechanism 12 non-operational and will generate a signal to the effect that this pick mechanism 12 requires attention by bank or service personnel.

The note picking apparatus described above has the advantage that it is highly reliable in operation. One reason for this reliability is that the diaphragm pump 156 continuously applies a reduced pressure to the suction pads 38 of the pick arms 36 of the selected pick mechanism 12 during the whole of the relevant pivotal movement of the pick arms 36, thereby substantially avoiding the risk of the end note 18' dropping off the pick arms 36 during this movement. In contrast, in operation of a known vacuum operated note picking apparatus in which a piston vacuum pump is used as the vacuum source, the suction force generated by the pump decays to zero during each cycle of the pump so that precise mechanical timing must be maintained to ensure that an adequate reduced pressure is applied to the suction pads of the pick arms of the selected pick mechanism during the whole of the relevant pivotal movement of the pick arms.

Another important reason for the reliability of the note picking apparatus described above is that for each pick mechanism 12 there is used an electrically operated valve 140 (FIG. 4) for controlling the application of suction force to the suction pads 38 of the relevant pick arms 36, operation of the valve 140 being controlled by signals from timing means (timing disc 68) which rotates in synchronism with the oscillatory movement of the pick arms 36, so that the timing signals provide an indication of the position of the pick arms 36 relative to the associated cassette 14. Thus, each timing disc 68 represents a simple means for ensuring that a suction force is always applied to, and removed from, the first note 18' in the relevant stack at the correct times. In addition, as explained hereinbefore, the electrically operated valves 140 enable the application of reduced pressure to the suction pads 38 of a selected pick mechanism 12 to be delayed by different amounts in response to changing operational requirements. Thus, the electrically operated valves 140 enable an increased suction force to be applied to the end note 18' of a stack from time to time, as may be required, for example, in the event of a pick failure occurring, or in the event of the temperature in the interior of the cash dispenser unit 10 falling below a predetermined minimum temperature specification. Also, the use of the electrically operated valves 140 makes it possible for the electronic control means 202 to decrease the suction force, for example in the event that it is found that there is a tendency for two notes to be picked in the course of a pick operation. As a result of this ability to vary the applied suction force, the reliability of the note picking apparatus described above is significantly enhanced compared with known note picking apparatuses.

The reliability of the note picking apparatus described above is also enhanced by virtue of the fact that the internal diameters of the connecting tubes 146 on the pump side of the valves 140 is greater than the internal diameters of the connecting tubes 42 connected to the tubular members 30, since this arrangement enables a suction force to become available at the suction pads 38 of the selected pick mechanism 12 within a very short time interval after the opening of the associated valve 140.

In a modified version of the note picking apparatus described above, instead of diaphragm pump 156 there could be used a vane pump which, in operation, also continuously generates a reduced pressure at an inlet port thereof.

What is claimed is:

1. An apparatus for removing sheets one by one from a stack of sheets held in a container, comprising:

pump means for generating a reduced pressure in operation;

suction means connected to said pump means and mounted in said apparatus for pivotal movement between first and second positions, said suction means serving when moved from said first position to said second position to withdraw part of an end sheet from said stack of sheets away from said stack of sheets by applying a suction force to said end sheet to move said end sheet to a pick-up area;

transport means to pick up said end sheet at said pick-up area and to remove said end sheet from said container;

valve means for connecting said pump means to said suction means;

timing means for generating timing signals indicative of the position of said suction means relative to said container;

said timing signals serving to control the operation of said valve means to enable said pump means to communicate with said suction means during the movement of said suction means from said first position to said second position;

temperature indicating means for indicating the temperature within said apparatus; and control means for controlling the operation of said apparatus to initiate the operation of said pump means and thereafter to enable said valve means to be operated by a timing signal generated by said timing means;

said control means also being effective to vary a time interval between the operation of said pump means and the operation of said suction means based upon the temperature indicated by said temperature indicating means.

2. An apparatus for removing sheets one by one from a stack of sheets held in a container, comprising:

pump means for generating a reduced pressure in operation;

suction means connected to said pump means and mounted in said apparatus for pivotal movement between first and second positions, said suction means serving when moved from said first position to said second position to withdraw part of an end sheet from said stack of sheets away from said stack of sheets by applying a suction force to said end sheet to move said end sheet to a pick-up area;

transport means to pick up said end sheet at said pick-up area and to remove said end sheet from said container;

valve means for connecting said pump means to said suction means; and timing means for generating timing signals indicative of the position of said suction means relative to said container;

said timing signals serving to control the operation of said valve means to enable said pump means to communicate with said suction means during the movement of said suction means from said first position to said second position;

said timing means including a timing disc coupled to said suction means to rotate in synchronism with the pivotal movement of said suction means, and also includes a sensing means associated with said timing disc to generate timing signals;

said apparatus including control means for controlling the operation of said apparatus, said control means being effective during a sheet removal operation to initiate the operation of said pump means, and thereafter to enable said valve means to be operated by a timing signal generated by said timing means;

said control means including an electronic control means, and a gate having first and second inputs thereto; said first input receiving one of said timing signals and said second input receiving an enabling signal from said electronic control means during a sheet removal operation with the output of said gate being used to control the operation of said valve means;

said electronic control means including means for varying a time interval between the operation of said pump means and the operation of said suction means;

said apparatus also including a temperature indicating means for indicating the temperature within said apparatus; said temperature indicating means having an output coupled to said electronic control means to vary said time interval between the operation of said pump means and the operation of said suction means depending upon the temperature indicated by said temperature indicating means.

3. The apparatus as claimed in claim 2 in which said apparatus also includes a sheet removed sensing means to sense whether a sheet has been successfully removed from said container during a said sheet removal operation; said sheet removed sensing means having an output coupled to said electronic control means to indicate a successful sheet removal operation or an unsuccessful sheet removal operation;

said electronic control means being effective to initiate a first retry operation in the event that an unsuccessful sheet removal operation is indicated; and said electronic control means being effective to increase said time interval between the operation of said pump means and the operation of said suction means in said first retry operation compared to said unsuccessful sheet removal operation.

4. The apparatus as claimed in claim 3 in which said electronic control means is effective to initiate a second retry operation in the event that said first retry operation is unsuccessful, and in which said electronic control means is effective to increase said time interval in said second retry operation compared to said first retry operation.

5. In an apparatus for removing sheet one by one from a stack of sheets by a suction member, a method comprising the steps of:

(a) sensing the temperature within the apparatus; and (b) applying a stronger vacuum to said suction member as the temperature within the apparatus falls when compared to a predetermined temperature and vacuum.

6. In an apparatus for removing sheets one by one from a stack by a suction member, the improvement comprising:

means for sensing the temperature within the apparatus and for generating a temperature output in accordance with the temperature in said apparatus; and means for applying a stronger vacuum to said suction member in response to said temperature output as the temperature within the apparatus falls when compared to a predetermined temperature and vacuum.

7. The apparatus as claimed in claim 6 in which said suction member has a suction pad thereon to contact a sheet in said stack of sheets, and in which said suction pad becomes less flexible as said temperature within the apparatus falls with respect to said predetermined temperature.

* * * * *

UNITED STATES PATENT AND TRADEMARK OFFICE

CERTIFICATE OF CORRECTION

PATENT NO. : 5,112,040

DATED : May 12, 1992

INVENTOR(S) : Johnston et al.

It is certified that error appears in the above-identified patent and that said Letters Patent is hereby corrected as shown below:

Column 14, line 10, "sheet" should be --sheets--.

Signed and Sealed this

Nineteenth Day of October, 1993

*Attest:*

*Attesting Officer*

BRUCE LEHMAN

*Commissioner of Patents and Trademarks*